US009058958B2

(12) United States Patent
Aoki et al.

(10) Patent No.: US 9,058,958 B2
(45) Date of Patent: Jun. 16, 2015

(54) RADIATION GENERATING APPARATUS AND RADIATION IMAGING APPARATUS

(75) Inventors: Shuji Aoki, Yokohama (JP); Koji Yamazaki, Ayase (JP); Yoshihiro Yanagisawa, Fujisawa (JP); Kazuyuki Ueda, Tokyo (JP); Miki Tamura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 373 days.

(21) Appl. No.: 13/539,871

(22) Filed: Jul. 2, 2012

(65) Prior Publication Data

US 2013/0034207 A1 Feb. 7, 2013

(30) Foreign Application Priority Data

Aug. 3, 2011 (JP) ..... 2011-169860

(51) Int. Cl.

*H01J 35/18* (2006.01)
*H01J 35/04* (2006.01)
*H01J 35/16* (2006.01)

(52) U.S. Cl.

CPC ..... *H01J 35/18* (2013.01); *H01J 35/04* (2013.01); *H01J 35/16* (2013.01); *H01J 2235/06* (2013.01); *H01J 2235/087* (2013.01); *H01J 2235/1204* (2013.01); *H01J 2235/1216* (2013.01); *H01J 2235/122* (2013.01); *H01J 2235/1262* (2013.01); *H01J 2235/1291* (2013.01); *H01J 2235/16* (2013.01); *H01J 2235/167* (2013.01); *H01J 2235/186* (2013.01)

(58) Field of Classification Search

CPC ..... H01J 35/16; H01J 35/18; H01J 2235/087; H01J 2235/122; H01J 2235/183; H01J 2235/186
USPC ..... 378/139, 140, 161
See application file for complete search history.

(56) References Cited

U.S. PATENT DOCUMENTS

| | | | | |
|---|---|---|---|---|
| 2008/0080672 | A1* | 4/2008 | Anno | 378/130 |
| 2008/0144777 | A1* | 6/2008 | Wilson | 378/198 |
| 2009/0010393 | A1* | 1/2009 | Klinkowstein et al. | 378/140 |
| 2011/0235783 | A1 | 9/2011 | Ogura et al. | |
| 2012/0121069 | A1 | 5/2012 | Aoki et al. | |

FOREIGN PATENT DOCUMENTS

| | | | |
|---|---|---|---|
| JP | 61-66399 | A | 4/1986 |

* cited by examiner

*Primary Examiner* — Glen Kao
(74) *Attorney, Agent, or Firm* — Fitzpatrick, Cella, Harper & Scinto

(57) ABSTRACT

The present invention relates to a radiation generating apparatus which includes an envelope provided with a first window through which radiation is transmitted, a radiation tube housed in the envelope and provided with a second window through which the radiation is transmitted, the second window being located at a position opposite the first window, and an insulating fluid adapted to fill the space between the inner wall of the envelope and the radiation tube. Plural plates are arranged side by side between the first window including its periphery and the second window including its periphery, and overlapping one another with gaps between them. The gaps are formed among the plates, and thereby the withstanding voltage between the first window and second window is made larger.

16 Claims, 4 Drawing Sheets

RADIATION GENERATING APPARATUS AND RADIATION IMAGING APPARATUS

BACKGROUND OF THE INVENTION

1. Field of the Invention

The present invention relates to a radiation generating apparatus equipped with a radiation tube in an envelope filled with an insulating fluid as well as to a radiation imaging apparatus which uses the radiation generating apparatus.

2. Description of the Related Art

A radiation generating apparatus is known which includes a radiation tube housed in an envelope, where the radiation tube in turn includes an electron source and target placed in an enclosed internal space. The radiation generating apparatus generates radiation by irradiating the target with electrons emitted from the electron source.

To generate radiation suitable for radiography, it is necessary to apply a voltage as high as 40 kV to 150 kV between the electron source and target, the electron source being a cathode in the radiation tube, and irradiate the target with an electron beam accelerated to high energies. Generally, the envelope is made of a metal material, whose potential is defined to be 0 V. Consequently, a high potential difference of at least a few tens of kV is produced between the electron source and target as well as between the radiation tube and envelope. Therefore, in order to generate radiation stably for a long period of time, the radiation generating apparatus is required to have withstanding voltage characteristics that are sufficient against such high voltages.

Japanese Patent Application Laid-Open No. S61-066399 discloses a rotary anode X-ray tube apparatus which secures a withstanding voltage by filling insulating coolant oil between a rotary anode X-ray tube and an inner wall of an envelope. By allowing the insulating coolant oil to flow freely between the rotary anode X-ray tube and envelope, the X-ray tube apparatus prevents sludge from adhering to a surface of the rotary anode X-ray tube and reduces electrical discharges between the rotary anode X-ray tube and envelope.

However, with the conventional technique, electrical discharges sometimes occur between the rotary anode X-ray tube and envelope via an inflow/outflow port used to allow the insulating coolant oil to flow as well as via an X-ray emission port of the rotary anode X-ray tube. Also, there is a problem in that if the X-ray tube is damaged by electrical discharges, X-rays cannot be generated stably for a long period of time.

As a method for dealing with this problem, it is conceivable to provide a sufficiently thick insulating coolant oil layer between the rotary anode X-ray tube and the inner wall of the envelope. However, withstanding voltage performance of insulating liquids such as insulating coolant oil is more susceptible to electrode shape, electrode surface properties, temperature, impurities, convection, and the like than other insulating materials. Therefore, the insulating coolant oil layer between the rotary anode X-ray tube whose temperature becomes as high as 200° C. or more during operation and the inner wall of the envelope needs to be set to a thickness large enough to avoid electrical discharges. Consequently, the envelope grows in size, increasing the size and weight of the entire X-ray generating apparatus. Also, increases in the thickness of the insulating coolant oil layer result in increases in attenuation quantity of the X-rays passing through the insulating coolant oil layer. To make up for the attenuation quantity, it becomes necessary to increase voltage, current, and operating time, resulting in increases in power consumption.

The above problems are not peculiar to reflection-type radiation generating apparatus, and transmission-type radiation generating apparatus are subject to similar problems. Therefore, both the reflection type and transmission type are expected to downsize the apparatus by minimizing the distance between the radiation tube and envelope, secure the withstanding voltage, making electrical discharges between the radiation tube and envelope less liable to occur, and reduce the attenuation quantity of radiation.

Thus, an object of the present invention is to provide a radiation generating apparatus which, having a configuration in which a radiation tube is placed in an envelope filled with an insulating liquid, has realized downsizing of the apparatus, improvement of the withstanding voltage between the envelope and radiation tube, and reduction in the attenuation quantity of radiation as well as to provide a radiation imaging apparatus which uses the radiation generating apparatus.

SUMMARY OF THE INVENTION

The present invention can both downsize the entire apparatus and secure withstanding voltage characteristics in a balanced manner. The downsizing allows reductions in radiation quantities to be avoided and thereby enables power savings. The ensured withstanding voltage characteristics stabilize radiation output.

According to an aspect of the present invention, a radiation generating apparatus comprises: an envelope having a first window through which radiation is transmitted; a radiation tube being held within the envelope, having a second window through which the radiation is transmitted, and being arranged such that the first and second window are opposite to each other; an insulating fluid filling the space between the envelope and the radiation tube, with a plurality of insulating plates arranged overlapping each other and separated from each other by gap(s), between the first window and the periphery of the first window, and the second window and the periphery of the second window.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A radiation generating apparatus and radiation imaging apparatus according to the present invention will be described below with reference to concrete embodiments.

First Embodiment

Figure 1:
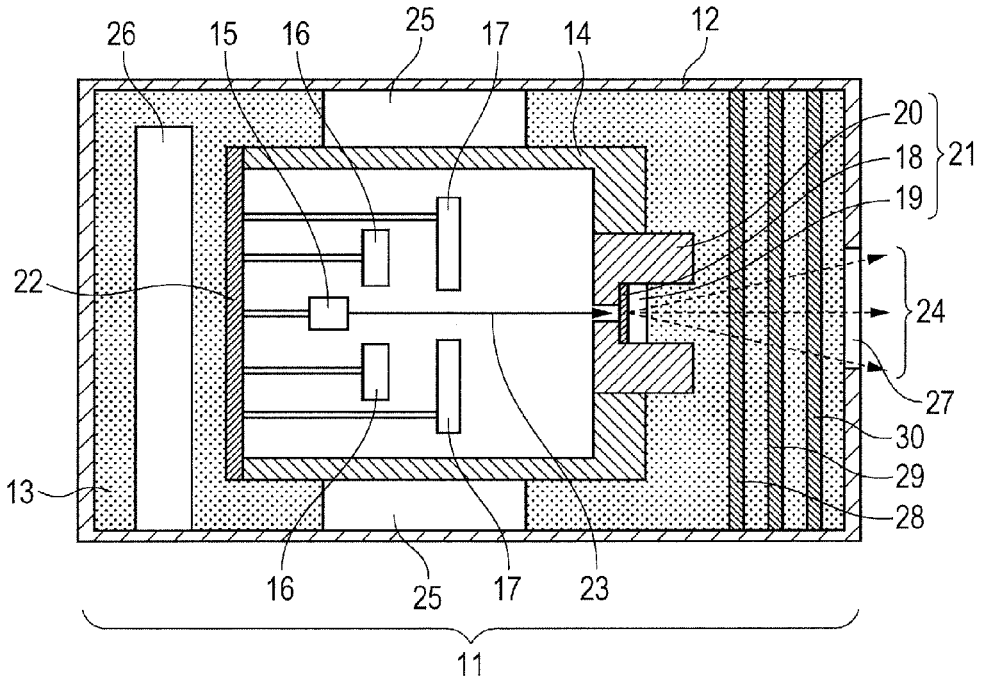
FIG. 1 is a schematic sectional view of a radiation generating apparatus according to a first embodiment.

FIG. 1 is a schematic sectional view of a radiation generating apparatus (transmission type radiation source) 11 according to the present embodiment.

A transmission type radiation tube 14 is housed in an envelope 12, with an insulating fluid 13 filling between the envelope 12 and radiation tube 14. The radiation tube 14 is tubular in shape and is held in the envelope 12 when a body of the radiation tube 14 is connected to a holding member 25 fixed to an inner wall of the envelope 12. The insulating fluid 13 is designed to be able to circulate around the radiation tube 14. Examples of materials available for the envelope 12 include metals such as iron, stainless steel, lead, brass and copper. As a fill port (not shown) for the insulating fluid 13 is provided in part of the envelope 12, the insulating fluid 13 can be poured into the envelope 12 through the fill port. A pressure relief port (not shown) made of elastic material is installed, as required, in part of the envelope 12 to avoid pressure increases in the envelope 12 when the insulating fluid 13 undergoes temperature increases and thereby expands in the radiation generating apparatus 11 in operation.

It is recommended that the insulating fluid 13 has good electrical insulation properties and high cooling capacity. Either an insulating liquid or insulating gas will do. Also, it is recommended that the insulating fluid 13 is resistant to thermal alteration because heat is transmitted to the insulating fluid 13 from a target 18 which becomes hot due to heat generation. For example, electrically insulating oil and fluorine-based insulating gas are available for use. The use of gas can make the apparatus lighter than when a liquid is used.

The radiation tube 14 includes an electron source 15 placed inside a vacuum vessel tubular in shape, and the target 18 placed at one end of the tubular shape, facing the electron source 15. Electrons emitted from the electron source 15 are directed at the target 18, causing radiation (X-rays, in this case) to be generated from the target 18. The generated radiation is emitted outside the envelope 12 by passing through a target board 19 (hereinafter referred to simply as a board) and first window 27. The vacuum vessel has the cylindrical body plugged at one end with an anode 21 made up of the target 18, the board 19 and a shielding member 20, and at the other end with a cathode 22 which supports the electron source 15. The vacuum vessel may be shaped as a square tube or the like alternatively. In order to keep the degree of vacuum in the vacuum vessel to $1\times10^{-4}$ Pa or below which will generally allow operation of the electron source 15, a barium getter, NEG or small ion pump (not shown) adapted to absorb gas released from the radiation tube 14 in operation may be placed in the vacuum vessel. It is recommended that material for the body of the vacuum vessel has good electrical insulation properties, allows a high vacuum to be maintained, and has high heat resistance. For example, alumina and glass are available for use. Regarding the electron source 15, a filament, impregnated cathode, and field-emission type device are available for use.

The target 18 is placed on an electron source side of the board 19, facing the electron source 15. Examples of materials available for the target 18 include metals such as tungsten, molybdenum, and copper.

The board 19 is a member adapted to support the target 18 and is a window adapted to allow passage of the radiation generated by the target 18 and thereby emit the radiation outside the radiation tube 14. Also, the board 19 is joined to the shielding member 20 by silver brazing or the like, where the shielding member 20 has a tubular shape, has a function to absorb the radiation generated by the target 18 and radiated in unnecessary directions, and functions as a thermal diffuser for the board 19. The shape of the shielding member 20 may be cylindrical or square tubular. The electrons emitted from the electron source 15 are directed at the target 18 through an opening (electron path) formed in that part (inner side) of the shielding member 20 which is located on the side of the electron source 15. Consequently, radiation is radiated in all directions from the target 18 irradiated with the electrons. After being transmitted through the board 19, the radiation passes through an opening (radiation path) formed in that part (outer side) of the shielding member 20 which is located on the side opposite the electron source 15, and then emitted outside the envelope 12 through the first window 27. The radiation path is located on the outer side of the board 19, protruding toward the first window 27 from an end of the vacuum vessel. This configuration is desirable because unnecessary radiation out of the radiation radiated outward from the target 18 can be shielded by an inner wall of the shielding member 20. According to the present embodiment, since the board 19 is joined to the tubular shielding member 20, the heat generated by the target 18 together with radiation is transmitted to the board 19 and shielding member 20, and then to the insulating fluid 13 and radiation tube 14. Incidentally, it is not strictly necessary to install the board 19. When the board 19 is not installed, the target 18 is joined to the tubular shielding member 20 by silver brazing or the like, and configured to serve as a window through which the radiation is emitted outside the radiation tube 14. In this case, the heat generated by the target 18 is transmitted to the insulating fluid 13 and shielding member 20, and then to the radiation tube 14. It is recommended that material for the board 19 has high thermal conductivity and low radiation absorbing capacity. Examples of materials available for use include SiC, diamond, carbon, thin-film oxygen-free copper and beryllium. Hereinafter, the board 19 will be referred to as a "second window 19." It is recommended that material for the shielding member 20 has high radiation absorbing capacity. Examples of materials available for use include metals such as tungsten, molybdenum, oxygen-free copper, lead and tantalum.

With the first window 27 being placed opposite the second window 19, radiation 24 emitted through the second window 19 is passed through the insulating fluid 13 and then emitted outside the envelope 12 through the first window 27 installed in a radiation-emitting portion of the envelope 12. Between the first window 27 including its periphery and the second window 19 including its periphery, three insulating plates (hereinafter referred to simply as plates) 28, 29 and 30 are arranged by overlapping one another with intervening gaps. The gaps among the plates 28, 29 and 30 are also filled with the insulating fluid 13. The radiation 24 is emitted outside the envelope 12 through the first window 27 by passing through the plates 28, 29 and 30. Holes for circulation of the insulating fluid 13 may be made in the plates 28, 29 and 30 to allow the insulating fluid 13 in the gaps to circulate. It is recommended that the material for the first window 27 is a material with a relatively small radiation attenuation quantity such as acrylic, polycarbonate, or aluminum.

Now, a relationship between thickness and withstanding voltage of a plate will be described with reference to FIG. 2.

Figure 2:
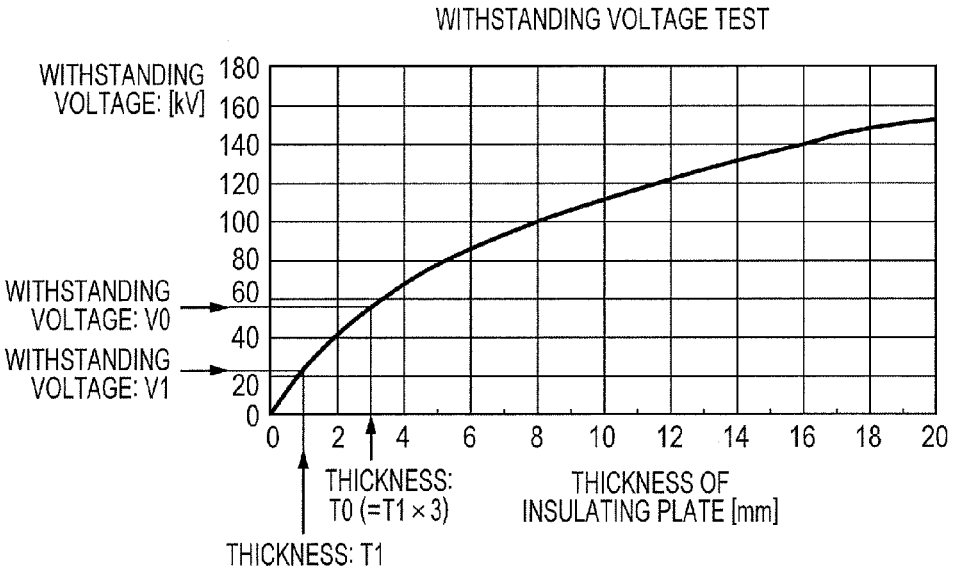
FIG. 2 is a diagram showing a relationship between thickness and withstanding voltage of plates used for the radiation generating apparatus according to the first embodiment.

As can be seen from FIG. 2, the withstanding voltage of the plate increases with increases in the thickness of the plate, but there is not necessarily direct proportionality between the thickness and withstanding voltage of the plate. Let us assume that the thicknesses of the plates 28, 29 and 30 are equally T1 and let V1 denote the withstanding voltage at T1. If the thickness three times the thickness T1 is denoted by T0 and the withstanding voltage at T0 is denoted by V0, the value three times the withstanding voltage V1 is larger than the withstanding voltage V0. That is, the sum of the withstanding voltages of the plates 28, 29 and 30 is larger than the withstanding voltage of a plate whose thickness is equal to the total thickness of the plates 28, 29 and 30. Thus, when the plates 28, 29 and 30 are arranged side by side by being separated by gaps as with the present embodiment, the withstanding voltage between the first window 27 and second window 19 is larger than when a plate whose thickness is equal to the total thickness of the plates 28, 29 and 30 is placed. Incidentally, the insulating fluid as well as the distance between the first window 27 including its periphery and the second window 19 including its periphery are the same in both the two conditions described above.

Next, description will be given of what size is required of the gaps among the plural plates in order for each of the plates to maintain withstanding voltage performance. For example, if the plates 28 and 29 are arranged in close contact without a gap, the withstanding voltage of the plates equals that of a plate whose thickness is equal to the total thickness of the plates 28 and 29. It is known that a gap larger than the electron penetration depth $d_0$ of the members located in the gap between the plates is generally sufficient for each of the plates to maintain withstanding voltage performance. This is because a gap larger than the electron penetration depth $d_0$ of the members located in the gap can keep electrons from penetrating the members located in the gap and thereby allow the members on the high-potential side to maintain withstanding voltage performance. The electron penetration depth $d_0$ is given by the equation below using a potential difference ΔV [kV] applied to the gap and density ρ [g/cm$^3$] of the members located in the gap.

$$d_0\,[\mu m]=5.2\times10^{-6}\times2.3\times\Delta V^{1.8}/\rho$$

A relationship between the potential difference ΔV applied to the gap and the electron penetration depth $d_0$ when the gap is filled with electrically insulating oil (ρ=0.88 [g/cm$^3$]) which is an insulating fluid has been calculated using the equation above and calculation results are shown in Table 1.

TABLE 1

| | Potential difference ΔV [kV] | | | | | | |
|---|---|---|---|---|---|---|---|
| | 0.5 | 1 | 3 | 5 | 10 | 35 | 50 |
| Electron penetration depth $d_0$ [μm] | 0.04 | 0.14 | 0.98 | 2.47 | 8.56 | 81.9 | 156 |

When the gap is set to 1 μm, if the potential difference applied to the gap is 3 kV or below, the electron penetration depth $d_0$ will not exceed 1 Σm. When the gap is set to 10 μm, if the potential difference applied to the gap is 10 kV or below, the electron penetration depth $d_0$ will not exceed 10 μm. When the gap is set to 100 μm, if the potential difference applied to the gap is 35 kV or below, the electron penetration depth $d_0$ will not exceed 100 μm. Therefore, according to the present embodiment, it can be seen that in order for the plate to maintain withstanding voltage performance, the distance of the gap can be determined by taking into consideration the potential difference ΔV applied to the gap. Consider, for example, a case in which the potential difference between the first window 27 and second window 19 is approximately 60 kV in a radiation generating apparatus 11 which uses a power system of a mid-point ground type (described later). In this case, if a group of three 1-mm thick polyimide plates with a withstanding voltage of 22 kV each are used, the three plates can secure a withstanding voltage of 66 kV in total. With this configuration, should one of the plates be short-circuited due to dielectric breakdown caused by electrical discharges, the potential difference ΔV applied to the gap between the remaining two plates will not reach or exceed 50 kV. Therefore, it can be seen from Table 1, that a gap distance of 156 μm or above is sufficient. Also, an unnecessarily large gap length will increase the overall length of the radiation tube 14. Thus, an appropriate range of the gap length is 150 μm to 1 mm. Desirably all the gaps among the plates 28, 29 and 30 are equal in length. Incidentally, the withstanding voltage of the electrically insulating oil filled into the gaps is given only limited consideration as an element for increasing a safety factor. Also, the material put in the gaps among the plates is not limited to the electrically insulating oil described above.

It is recommended that the material for the plates 28, 29 and 30 has good electrical insulation properties and a small radiation attenuation quantity. For example, polyimide, ceramics, epoxy resin and glass are used suitably. Desirably the same material is used for all the plates 28, 29 and 30. From the perspective of securing withstanding voltage characteristics between the first window 27 and second window 19, desirably the thickness of the plates 28, 29 and 30 is 0.01 mm to 6 mm. Desirably all the plates 28, 29 and 30 are equal in thickness. According to the present embodiment, the plates 28, 29 and 30 can be polyimide plates 1 mm thick each. In this case, the withstanding voltage can be improved by approximately 10 kV over a plate whose thickness is equal to the total thickness of the plates. However, the material of the plates is not limited to this and may be selected appropriately according to the distance between the first window 27 and second window 19, the withstanding voltage of the insulating fluid 13 filling between the inner wall of the envelope 12 and the radiation tube 14, and the like. A material with better electrical insulation properties than the insulating fluid 13 or a material with radiation transmittance equal to or higher than that of the insulating fluid 13 may be used for the plates.

The holding member 25 is intended to hold a body of the radiation tube 14. In FIG. 1, the radiation tube 14 is held at two locations on the body by the holding member 25, but it is sufficient for the radiation tube 14 to be held at least at one or more locations on the body by the holding member 25. Examples of materials available for the holding member 25 include conductive materials such as iron, stainless steel, brass and copper as well as materials having insulation properties, such as engineering plastics and ceramics.

A first control electrode 16 is intended to draw the electrons generated by the electron source 15 and a second control electrode 17 is intended to control focus diameter of the electrons at the target 18. When the first control electrode 16 and second control electrode 17 are provided as in the case of the present embodiment, an electron beam 23 emitted from the electron source 15 by an electric field formed by the first control electrode 16 is caused to converge by the second control electrode 17 through electric-potential control. The target 18 has a positive potential relative to the electron source 15, and thus the electron beam 23 passing through the second control electrode 17 is drawn toward the target 18, collides with the target 18, and thereby generates radiation 24. ON/OFF control of the electron beam 23 is performed using a voltage of the first control electrode 16. Available materials for the first control electrode 16 include stainless steel, molybdenum and iron.

A power supply circuit 26 is connected to the radiation tube 14 (wiring is not shown) and intended to supply electric power to the electron source 15, first control electrode 16, second control electrode 17 and target 18. According to the present embodiment, the power supply circuit 26 is placed in the envelope 12, but may be placed outside the envelope 12.

In taking radiographs of a human body or the like, the target 18 is about +30 kV to 150 kV higher in potential than the electron source 15. This potential difference is an accelerating potential difference needed for the radiation generated from the target 18 to be transmitted through the human body, contributing effectively to radiography. Generally, X-rays are used for radiography, but the present invention is also applicable to radiation other than X-rays.

The radiation generating apparatus 11 according to the present embodiment uses a power system of a mid-point ground type with a potential difference V between the target 18 and electron source 15 being set to 20 kV to 160 kV, a potential of +V/2 being applied to the target 18, a potential of −V/2 being applied to the electron source 15, and the holding member 25 being grounded. This is because these settings will generally allow downsizing of the envelope 12 in view of a dielectric breakdown distance of the insulating fluid 13. Also, the mid-point ground type is desirable in that it allows the absolute values of voltages of the target 18 and electron source 15 to be decreased and thereby allows the power supply circuit 26 to be downsized more than a grounded-anode type does. Even if the holding member 25 is placed and grounded at locations away from opposite ends of the radiation tube 14 instead of being grounded at the midpoint, the power supply circuit 26 can be downsized compared to the grounded-anode type.

When the radiation generating apparatus 11 configured as described above is operated at the potential difference V, the potentials of the target 18, second window 19 and shielding member 20 become +V/2. The first window 27 and envelope 12 facing the above group of components are at ground potential, and thus a potential difference of +V/2 is produced between the two groups of components. The produced potential difference is as high as 10 kV to 80 kV. From the perspective of downsizing of the apparatus, it is recommended to minimize the distance between the first window 27 including its periphery and the second window 19 including its periphery, but the reduced distance will increase the tendency toward electrical discharges. Also, electric fields generated at a potential difference of +V/2 are likely to concentrate depending on the shapes of the target 18, second window 19 and shielding member 20, making the neighborhood of the target 18 prone to electrical discharges. Furthermore, the radiation tube 14 generates intense heat at one end where the target 18 is provided. That is, the heat generated at the target 18 is transmitted to the second window 19 and shielding member 20, resulting in intense heat generation at the anode 21. For example, if the radiation generating apparatus 11 is operated at a power of about 150 W, it is estimated that a maximum temperature on a surface of the shielding member 20 will get 200° C. or above. Thus, with an insulator, such as an insulating liquid, whose withstanding voltage characteristics decrease under the influence of temperature, the neighborhood of the target 18 is more prone to electrical discharges.

Therefore, according to the present embodiment, as shown in FIG. 1, three plates 28, 29 and 30 are arranged between the first window 27 including its periphery and the second window 19 including its periphery by overlapping one another via gaps. The use of the plates provides insensitivity to the influence of temperature and the like and thereby improves the withstanding voltage between the first window 27 and second window 19 compared to when plates are not used. Generally, an insulating liquid such as electrically insulating oil has high electrical insulation properties and withstanding voltage characteristics, but the withstanding voltage characteristics are decreased in some cases by impurities, water, or air bubbles contained in the insulating liquid or produced as a result of degradation over time. Thus, installation of the plates allows high withstanding voltage characteristics to be maintained more reliably. Furthermore, the gaps among the plates are configured such that the withstanding voltage between the first window 27 and second window 19 will be higher than when a plate whose thickness is equal to the total thickness of the plates is placed instead of the three plates. Consequently, the withstanding voltage between the first window 27 and second window 19 is improved compared to when the plate whose thickness is equal to the total thickness of the plates 28, 29 and 30 is placed. Thus, the withstanding voltage can still be secured even if the apparatus is downsized by reducing the distance between the first window 27 including its periphery and the second window 19 including its periphery.

Also, the plate thickness of a single plate whose withstanding voltage is equal to the total withstanding voltage of the three plates is larger than the total plate thickness of the three plates. Therefore, the radiation attenuation quantity of the single plate is larger than the total radiation attenuation quantity of the three plates. Thus, the radiation attenuation quantity can be reduced if a group of three plates are placed and the distance between the first window 27 including its periphery and the second window 19 including its periphery is reduced by at least the difference between the plate thickness of the single plate and the total plate thickness of the three plates. Furthermore, layer thicknesses of the insulating fluid 13 among the plates can be reduced by the amount corresponding to the safety factor, reducing the size and weight of the envelope 12.

In this way, by adopting the configuration described above, the present embodiment can downsize the apparatus, improve the withstanding voltage between the envelope 12 and radiation tube 14, and reduce the attenuation quantity of radiation. This enables implementing a highly reliable radiation generating apparatus capable of generating radiation stably for a long period of time.

Incidentally, although in FIG. 1, the interior of the envelope 12 is partitioned completely by the plates 28, 29 and 30 into a part on the side of the first window 27 and a part on the side of the second window 19, the present invention is not limited to this arrangement. Electrical discharges are liable to occur especially between that end face of the anode 21 which is nearest to the first window 27 and the first window 27 including its periphery, and so it is sufficient if the plates 28, 29 and 30 are placed in a region facing that end face of the anode 21 which is nearest to the first window 27.

Also, although in FIG. 1, the plate 28 is spaced away from the second window 19 and its periphery while the plate 30 is spaced away from the first window 27 and its periphery, the present invention is not limited to this arrangement. The plate 28 may be in contact with the second window 19 and its periphery, and the plate 30 may be in contact with the first window 27 and its periphery.

Furthermore, the shape of the anode 21 is not limited to the one shown in FIG. 1. It is not strictly necessary that part of an end face of the shielding member 20 protrude toward the first window 27 from the window 19 as shown in FIG. 1. For example, the present invention is also applicable when the end face of the shielding member 20 is flush with that face of the second window 19 which is located on the side of the first window 27.

Second Embodiment

Figure 3:
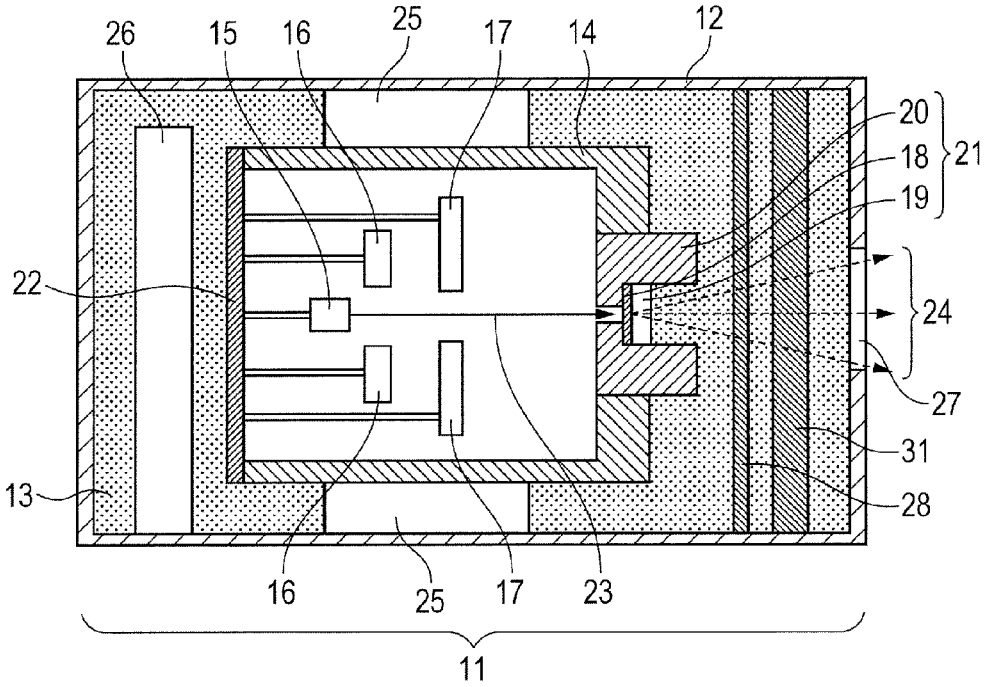
FIG. 3 is a schematic sectional view of a radiation generating apparatus according to a second embodiment.

FIG. 3 is a schematic sectional view of a radiation generating apparatus 11 according to the present embodiment.

The radiation generating apparatus (transmission type radiation source) 11 according to the present embodiment differs from the first embodiment in that two plates 28 and 31 of different thicknesses are placed between the first window 27 and second window 19. Otherwise, the present embodiment is the same as the first embodiment, and thus description of components other than the plates 28 and 31 as well as configuration of the radiation generating apparatus 11 will be omitted.

According to the present embodiment, two plates 28 and 31 are arranged side by side between the first window 27 including its periphery and the second window 19 including its periphery by being separated by a gap. The gap is also filled with the insulating fluid 13 which fills between the inner wall of the envelope 12 and the radiation tube 14. Consequently, the radiation 24 is emitted outside the envelope 12 through the first window 27 by passing through the plates 28 and 31. Holes for circulation of the insulating fluid 13 may be made in the plates 28 and 31 to allow the insulating fluid 13 in the gaps to circulate.

Now, a relationship between thickness and withstanding voltage of a plate will be described with reference to FIG. 4, which shows tests results on the thicknesses and withstanding voltages of the plates used for the radiation generating apparatus according to the present embodiment.

Figure 4:
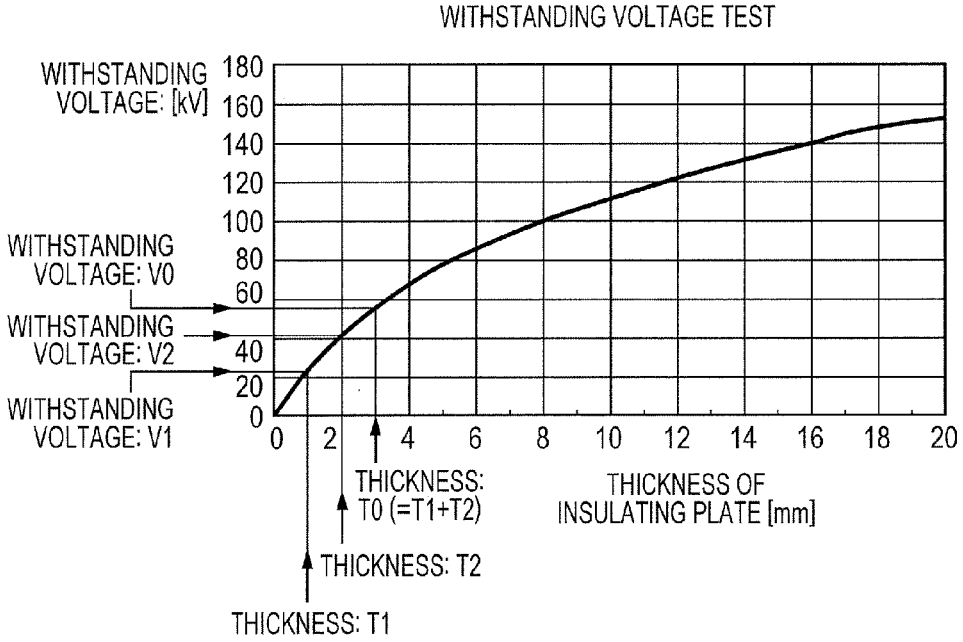
FIG. 4 is a diagram showing a relationship between thickness and withstanding voltage of plates used for the radiation generating apparatus according to the second embodiment.

As can be seen from FIG. 4, the withstanding voltage of the plate increases with increases in the thickness of the plate, but there is not necessarily a direct proportionality between the thickness and withstanding voltage of the plate. FIG. 4 will be described in more detail by applying FIG. 4 to the plates 28 and 31 of the radiation generating apparatus according to the present embodiment. If the thickness of the plate 28 is T1, the withstanding voltage at T1 is V1. Also, if the thickness of the plate 31 is T2, the withstanding voltage at T2 is V2. Here, if the sum of the thickness T1 and thickness T2 is T0, the withstanding voltage at T0 is V0, and it can be seen that the sum of the withstanding voltage V1 and withstanding voltage V2 is larger than the withstanding voltage V0. That is, the sum of the withstanding voltages of the plates 28 and 31 is larger than the withstanding voltage of a plate whose thickness is equal to the total of the thicknesses of the plates 28 and 31. Thus, when the plates 28 and 31 are arranged side by side by being separated by a gap as with the present embodiment, the withstanding voltage between the first window 27 and second window 19 is larger than when a plate whose thickness is equal to the total of the thicknesses of the plates 28 and 31 is placed. The gap distance between the plates 28 and 31 is determined in the same manner as in the first embodiment.

Advisably the material for the plates 28 and 31 has good electrical insulation properties and a small radiation attenuation quantity, and may be the same as the material used in the first embodiment. For example, polyimide, ceramics, epoxy resin and glass are used suitably. According to the present embodiment, the plate 28 can be a polyimide plate about 1 mm thick and the plate 31 can be a polyimide plate about 2 mm thick.

According to the present embodiment, as shown in FIG. 3, the two plates 28 and 31 are arranged side by side between the first window 27 including its periphery and the second window 19 including its periphery by being separated by a gap. Furthermore, the gap between the plates is configured such that the withstanding voltage between the first window 27 and second window 19 will be higher than when a plate whose thickness is equal to the total thickness of the plates is placed instead of the two plates. This provides insensitivity to the influence of temperature and the like and thereby improves the withstanding voltage between the first window 27 and second window 19 as with the first embodiment.

Also, the radiation attenuation quantity can be reduced if a group of two plates are placed and the distance between the first window 27 including its periphery and the second window 19 including its periphery is reduced by at least the difference between the plate thickness of the single plate and the total plate thickness of the two plates. Furthermore, layer thickness of the insulating fluid 13 can be reduced by the amount corresponding to the safety factor, reducing the size and weight of the envelope 12.

In this way, by adopting the configuration described above, the present embodiment provides advantages similar to those of the first embodiment.

Incidentally, it is sufficient if the plates 28 and 31 are placed in a region facing that end face of the radiation tube 14 which is nearest to the first window 27. Also, the plate 28 may be in contact with the second window 19 and its periphery, and the plate 31 may be in contact with the first window 27 and its periphery.

Third Embodiment

Figure 5:
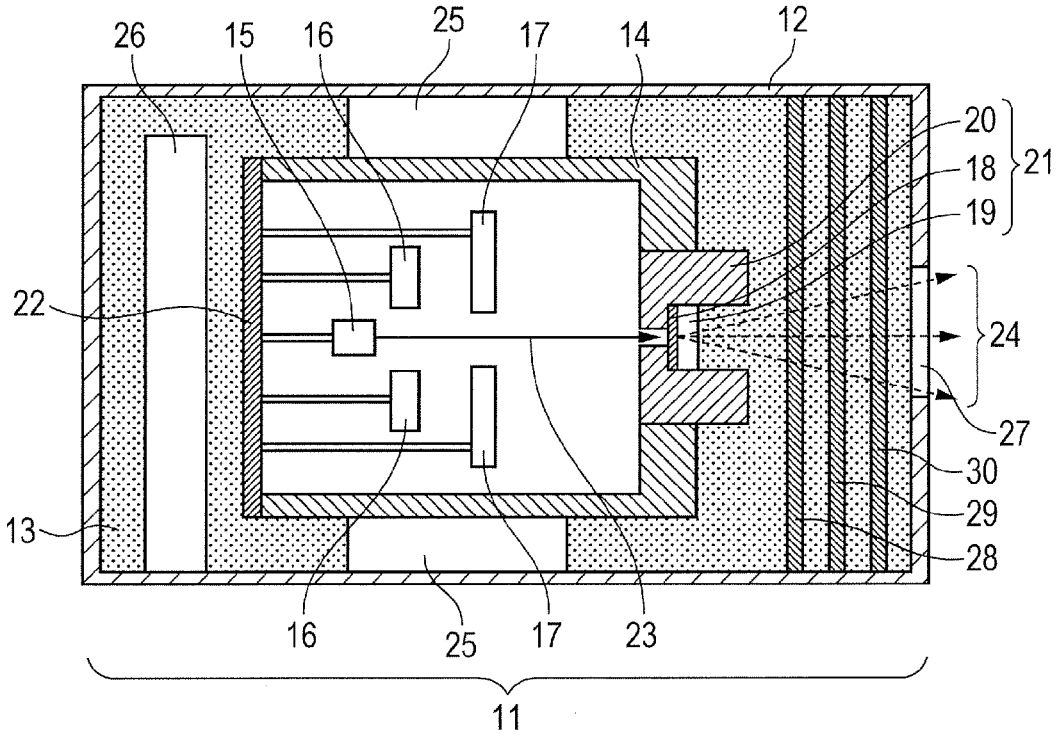
FIG. 5 is a schematic sectional view of a radiation generating apparatus according to a third embodiment.

FIG. 5 is a schematic sectional view of a radiation generating apparatus 11 according to the present embodiment.

As shown in FIG. 5, the radiation generating apparatus (transmission type radiation source) 11 according to the present embodiment differs from the first embodiment in that a gas is used as the insulating fluid 13. Otherwise, the present embodiment is the same as the first embodiment, and thus description of components other than the insulating fluid 13 as well as configuration of the radiation generating apparatus 11 will be omitted.

Gaseous insulating fluids 13 available for use include sulfur hexafluoride which has insulation performance equivalent to that of mineral oil-based insulating oil.

In this way, by adopting the configuration described above, the present embodiment provides advantages similar to those of the first embodiment. Furthermore, since a gas is used as the insulating fluid 13, the weight of apparatus can be made lighter than when a liquid is used, reducing the size and weight of the radiation generating apparatus 11 more than in the first embodiment.

Fourth Embodiment

Figure 6:
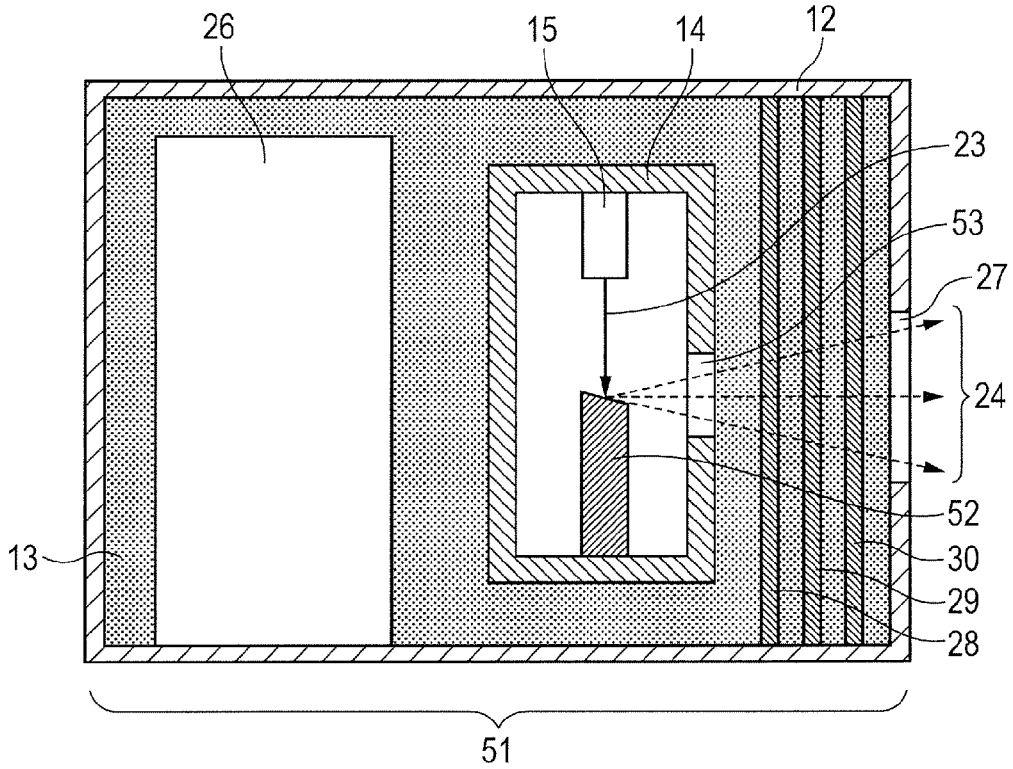
FIG. 6 is a schematic sectional view of a radiation generating apparatus according to a fourth embodiment.

FIG. 6 is a schematic sectional view of a radiation generating apparatus 11 according to the present embodiment.

As shown in FIG. 6, the radiation generating apparatus (reflection type radiation source) 51 according to the present embodiment differs from the first to third embodiments in that a reflection type radiation tube 14 is used. Otherwise, the present embodiment is the same as the first embodiment, and thus description of components other than a reflection type target 52, a second window 53 and the radiation tube 14 will be omitted.

The radiation generating apparatus 51 according to the present embodiment includes the envelope 12, insulating fluid 13, radiation tube 14, electron source 15, power supply circuit 26, first window 27, plates 28, 29 and 30, reflection type target 52 and second window 53.

The reflection type target 52 is placed, facing the second window 53 at a distance. The radiation tube 14 is a vacuum vessel which causes an electron beam 23 emitted from the electron source 15 to collide with the reflection type target 52, thereby generating radiation 24. After passing through the second window 53 which is part of the radiation tube 14, the radiation 24 is emitted outside the envelope 12 through the first window 27.

Again in the present embodiment, three plates 28, 29 and 30 are arranged side by side between the first window 27 including its periphery and the second window 53 including its periphery by overlapping one another via gaps. The gaps are also filled with the insulating fluid 13 which fills between the inner wall of the envelope 12 and the radiation tube 14. The gap distance among the plates is determined in the same manner as in the first embodiment. Consequently, the radiation 24 is emitted outside the envelope 12 through the first window 27 by passing through the plates 28, 29 and 30. Holes for circulation of the insulating fluid 13 may be made in the plates 28, 29 and 30 to allow the insulating fluid 13 in the gaps to circulate.

In this way, by adopting the configuration described above, the present embodiment provides advantages similar to those of the first embodiment.

Incidentally, it is sufficient if the plates 28, 29 and 30 are placed in a region facing that end face of the radiation tube 14 which is nearest to the first window 27. Also, the plate 28 may be in contact with the second window 53 and its periphery, and the plate 30 may be in contact with the first window 27 and its periphery.

Fifth Embodiment

Figure 7:
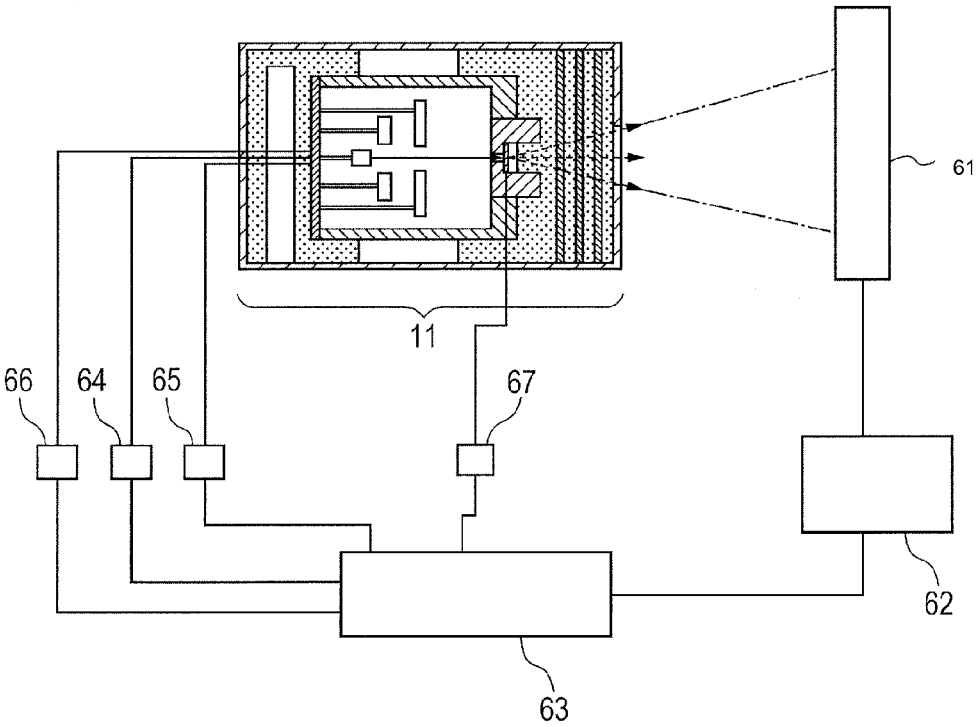
FIG. 7 is a configuration diagram of a radiation imaging apparatus which uses the radiation generating apparatus according to the present invention.

A radiation imaging apparatus which uses the radiation generating apparatus according to the present invention will be described with reference to FIG. 7. FIG. 7 is a configuration diagram of the radiation imaging apparatus according to the present embodiment. The radiation imaging apparatus includes, a radiation generating apparatus 11, a radiation detector 61, a radiation detection signal processing unit 62, a system control unit 63, an electron source driving unit 64, an electron source heater control unit 65, a control electrode voltage control unit 66 and a target voltage control unit 67. The radiation generating apparatus according to any of the first to fourth embodiments is used suitably as the radiation generating apparatus 11.

The system control unit 63 performs cooperative control of the radiation generating apparatus 11 and radiation detector 61. Output signals from the system control unit 63 are connected to various terminals of the radiation generating apparatus 11 via the electron source driving unit 64, electron source heater control unit 65, control electrode voltage control unit 66 and target voltage control unit 67.

When radiation is generated by the radiation generating apparatus 11, the radiation released into the atmosphere is transmitted through a subject/object (not shown) and detected by the radiation detector 61 to produce a radiation transmission image. The radiation transmission image thus obtained can be displayed on a display unit (not shown).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-169860, filed Aug. 3, 2011, which is hereby incorporated by reference herein in its entirety.

What is claimed is:

1. An X-ray radiation generating apparatus comprising:

an envelope having a first window through which X-ray radiation is transmitted;

an X-ray radiation tube held within said envelope, having a second window through which the X-ray radiation is transmitted, and being arranged such that said first and second windows are opposite to each other;

an insulating fluid filling a space between said envelope and said X-ray radiation tube; and a plurality of insulating plates arranged overlapping each other in the radiating direction such that the X-ray radiation is passed through each of said insulating plates in turn, and separated from each other by gap(s), between said first window and said second window.

2. The radiation generating apparatus according to claim 1, wherein each said gap between said insulating plates has a length between said plates such that a withstanding voltage between said first and second windows is larger than a withstanding voltage that would be obtained between said first and second windows by substituting for said plurality of plates a single plate whose thickness equals a combined thickness of all of said plurality of plates.

3. The radiation generating apparatus according to claim 2, wherein each of said gap(s) between said insulating plates has a length from one said plate to a next one of said plates in a range of 150 μm to 1 mm.

4. The radiation generating apparatus according to claim 1, wherein said insulating plates are 2 or 3 in number.

5. The radiation generating apparatus according to claim 1, wherein said plurality of insulating plates are formed from the same material.

6. The radiation generating apparatus according to claim 1, wherein said plurality of insulating plates each have the same thickness.

7. The radiation generating apparatus according to claim 1, wherein said insulating plates each have the same thickness and each of said gap(s) has a length from one said plate to a next one of said plates equal to the thickness of one of said plates.

8. The radiation generating apparatus according to claim 1, wherein said plurality of insulating plates include an insulating plate whose thickness is different from those of the others of said insulating plates.

9. The radiation generating apparatus according to claim 1, wherein said X-ray radiation tube is transmission type.

10. The radiation generating apparatus according to claim 1, wherein said X-ray radiation tube is reflection type.

11. The radiation generating apparatus according to claim 1, wherein said insulating fluid is an electrically insulating oil.

12. The radiation generating apparatus according to claim 1, wherein said insulating fluid is air.

13. The radiation generating apparatus according to claim 1, wherein each said insulating plate has a thickness of 0.01 mm to 6 mm.

14. The radiation generating apparatus according to claim 1, wherein each said insulating plate is formed from a material selected from polyimide, ceramics, epoxy resin and glass.

15. The radiation generating apparatus according to claim 14, wherein each said gap(s) between said insulating plates is filled with an electrically insulating oil.

16. An X-ray radiation imaging apparatus comprising:

an X-ray radiation generating apparatus comprising:

an envelope having a first window through which X-ray radiation is transmitted;

an X-ray radiation tube being held within said envelope, having a second window through which the X-ray radiation is transmitted, and being arranged such that said first and said second windows are opposite to each other;

an insulating fluid filling a space between said envelope and said X-ray radiation tube; and a plurality of insulating plates arranged overlapping each other in the radiating direction so that the X-ray radiation is passed through each of said insulating plates, and separated from each other by gap(s), between said first window and said second window;

a radiation detector for detecting the X-ray radiation being emitted from said X-ray radiation generating apparatus and being transmitted through an object; and a control unit for controlling said X-ray radiation generating apparatus and said radiation detector to effect cooperation therebetween.

* * * * *